US012577955B2

(12) United States Patent
Van Houten

(10) Patent No.: US 12,577,955 B2
(45) Date of Patent: Mar. 17, 2026

(54) COUNTER-ROTATING FAN ASSEMBLY

(71) Applicant: Robert Bosch GmbH, Stuttgart (DE)

(72) Inventor: Robert Van Houten, Winchester, MA (US)

(73) Assignee: Robert Bosch GmbH, Stuttgart (DE)

( * ) Notice: Subject to any disclaimer, the term of this patent is extended or adjusted under 35 U.S.C. 154(b) by 412 days.

(21) Appl. No.: 17/535,216

(22) Filed: Nov. 24, 2021

(65) Prior Publication Data

US 2022/0170469 A1 Jun. 2, 2022

Related U.S. Application Data

(60) Provisional application No. 63/120,392, filed on Dec. 2, 2020.

(51) Int. Cl.

| | |
|---|---|
| ***F04D 19/02*** | (2006.01) |
| ***F04D 25/06*** | (2006.01) |
| ***F04D 29/38*** | (2006.01) |
| ***F04D 29/54*** | (2006.01) |
| ***F04D 29/58*** | (2006.01) |
| ***F04D 29/64*** | (2006.01) |
| *F01P 5/06* | (2006.01) |
| *F04D 29/16* | (2006.01) |

(52) U.S. Cl.

CPC ..... *F04D 19/024* (2013.01); *F04D 25/0606* (2013.01); *F04D 29/384* (2013.01); *F04D 29/541* (2013.01); *F04D 29/5826* (2013.01); *F04D 29/644* (2013.01); *F01P 5/06* (2013.01); *F04D 29/164* (2013.01); *F04D 29/545* (2013.01)

(58) Field of Classification Search

CPC .. F04D 19/024; F04D 25/0606; F04D 29/384; F04D 29/541; F04D 29/5826; F04D 29/644; F04D 29/542; F04D 29/544; F01P 2005/025

See application file for complete search history.

(56) References Cited

U.S. PATENT DOCUMENTS 4,548,548 A * 10/1985 Gray, III ..... F04D 29/544 416/189
4,657,483 A * 4/1987 Bede ..... F04D 29/545 74/609

(Continued)

FOREIGN PATENT DOCUMENTS

| | | |
|---|---|---|
| CN | 109854523 | 6/2019 |
| CN | 111043063 | 4/2020 |

(Continued)

*Primary Examiner* — Courtney D Heinle
*Assistant Examiner* — Behnoush Haghighian
(74) *Attorney, Agent, or Firm* — Kelly McGlashen; Maginot, Moore & Beck LLP

(57) ABSTRACT

A counter-rotating fan assembly includes an upstream fan that rotates in a first direction about a common axis and a downstream fan that rotates in a second, opposed direction about the common axis. The assembly has an upstream motor that drives the upstream fan, and an upstream motor support that supports the upstream motor. The assembly also has a downstream motor that drives the downstream fan, and a downstream motor support that supports the downstream motor. The upstream motor support is located upstream of the upstream fan, and the downstream motor support is located downstream of the downstream fan.

18 Claims, 5 Drawing Sheets

(56) References Cited

U.S. PATENT DOCUMENTS 5,244,347 A * 9/1993 Gallivan ..... F04D 29/325 416/189
5,342,167 A * 8/1994 Rosseau ..... F04D 29/544 415/220
5,443,363 A * 8/1995 Cho ..... F04D 29/164 415/223
5,489,186 A * 2/1996 Yapp ..... F01D 5/141 415/58.7
5,931,640 A * 8/1999 Van Houten ..... F04D 29/582 416/169 A
6,027,307 A * 2/2000 Cho ..... F04D 29/164 416/189
6,579,063 B2 * 6/2003 Stairs ..... F04D 29/326 416/243
6,595,744 B2 * 7/2003 Van Houten ..... F04D 29/582 415/173.1
6,755,157 B1 * 6/2004 Stevens ..... F04D 29/582 123/41.49
7,156,611 B2 * 1/2007 Oosawa ..... F04D 19/007 415/199.5
7,318,394 B2 * 1/2008 Stevens ..... F04D 29/646 123/41.49
7,478,993 B2 * 1/2009 Hong ..... F04D 29/547 415/173.1
7,762,769 B2 * 7/2010 Stevens ..... F04D 29/164 416/189
7,789,622 B2 * 9/2010 Acre ..... F04D 29/526 416/189
7,794,204 B2 * 9/2010 Stevens ..... F04D 29/547 416/189
8,137,070 B2 * 3/2012 Van Houten ..... F04D 29/164 416/223 R
8,487,466 B2 * 7/2013 Schroeder ..... B63H 5/10 415/60
8,568,095 B2 * 10/2013 Bushnell ..... F04D 29/384 416/235
9,004,860 B2 * 4/2015 Van Houten ..... F04D 29/681 415/222
9,404,511 B2 * 8/2016 Van Houten ..... F04D 29/384
9,784,277 B2 * 10/2017 Scouarnec ..... F04D 19/002
10,844,868 B2 * 11/2020 Van Houten ..... F04D 29/526
11,078,924 B2 * 8/2021 Schafer ..... F04D 29/522
11,384,767 B2 * 7/2022 Zhang ..... F04D 25/0646
11,428,238 B2 * 8/2022 Haaf ..... F04D 17/06
11,499,564 B2 * 11/2022 Van Houten ..... F04D 29/681
11,506,211 B2 * 11/2022 Li ..... F04D 29/384
2002/0076327 A1 * 6/2002 Houten ..... F04D 29/582 416/189
2003/0026699 A1 * 2/2003 Stairs ..... F04D 29/582 416/192
2007/0280829 A1 * 12/2007 Stevens ..... F04D 29/547 416/189
2008/0075585 A1 * 3/2008 Acre ..... F04D 29/164 415/177
2010/0068028 A1 * 3/2010 Bushnell ..... F04D 29/164 415/200
2011/0211949 A1 * 9/2011 Van Houten ..... F04D 29/681 415/220
2011/0223024 A1 * 9/2011 Van Houten ..... F04D 29/164 416/223 R
2014/0271172 A1 * 9/2014 Van Houten ..... F04D 29/681 415/211.1
2014/0363272 A1 12/2014 Kitamura et al.
2015/0071776 A1 * 3/2015 Scouarnec ..... F04D 19/002 415/208.2
2018/0094637 A1 * 4/2018 Van Houten ..... F04D 29/164
2021/0095684 A1 * 4/2021 Van Houten ..... F04D 29/164
2021/0388839 A1 * 12/2021 Li ..... F04D 29/703

FOREIGN PATENT DOCUMENTS

| | | |
|---|---|---|
| DE | 102007021604 | 11/2007 |
| DE | 112015001218 | 2/2017 |
| DE | 102019213315 | 3/2021 |
| JP | 6756412 | 8/2020 |
| WO | 2017127754 | 7/2017 |

* cited by examiner idle ram-air

COUNTER-ROTATING FAN ASSEMBLY

BACKGROUND

Although current automobiles employ a variety of powertrains, there is in every case a requirement to provide cooling. Typically this cooling function is achieved by the use of axial fans mounted in such a way that one Of more fans either push or pull an through a stack of one or more heat exchangers. These heat exchangers can include radiators, condensers, charge-air coolers, and other types of heat exchanger. If multiple fans are employed they are typically oriented "side-by-side", moving air in parallel. This is typically the case when the shape of the heat exchangers does not lend itself to the use of a single fan.

Automotive cooling fans are typically located at the front of the vehicle, often behind a grill. When the vehicle is moving, the air pressure in front of the vehicle increases. A portion of this pressure increase is applied to the front surface of the heat exchangers. This allows the fan or fans to move more air, and provide more cooling.

The fans are typically powered by electric motors, which are supported by structures connected to shrouds which surround the one or more fans, and guide the air between the heat exchangers and the fans. These motor supports may advantageously include a set of vanes that extend from a motor mount to the shroud in an approximately radial direction. As used herein, the term radial is used with reference to a rotation axis of the fans, and refers to a direction that is perpendicular to the rotation axis.

These motors require electric power provided by one or more alternators, or by a battery. To maximize the range of an electric vehicle, or to minimize the fuel consumption of an engine-powered vehicle, the fans are designed to be as efficient as possible. One cause of inefficiency is the swirl induced into the air stream leaving the fan, which represents energy lost to the system.

Efforts to capture the energy lost due to swirl of the airstream leaving the fans, and thereby increase the efficiency of the fans, have been directed towards the use of counter-rotating fans. In this configuration, two fans are mounted on the same rotation axis, and turn in opposite directions. The downstream fan can thereby recover the swirl energy imparted by the upstream fan, so that the velocity of the air leaving the downstream fan is primarily axial. As used herein, the terms "upstream" and "downstream" refer to a relative position with respect to the direction of airflow through the fan assembly. The tern "axial" refers to the direction of the rotation axis.

In order to power a counter-rotating fan assembly, one can use either a single, counter-rotating motor, or two motors, each driving one of the fans.

SUMMARY

A counter-rotating fan assembly is described herein in which each fan is driven by a separate motor, each motor is supported by a separate motor support, and each motor support is positioned in such a way that parasitic losses may be minimized. The positioning of the motor supports may also facilitate the cooling of the motors. The overall length of the fan assembly, as measured from the downstream face of the downstream-most heat exchanger, may also be minimized.

In one aspect, the counter-rotating fan assembly includes an upstream fan and a downstream fan, rotating in opposite directions around a substantially common axis. An upstream motor drives the upstream fan, and an upstream motor support supports the upstream motor. A downstream motor drives the downstream fan, and a downstream motor support supports the downstream motor. In addition, a barrel surrounds at least a portion of the upstream fan and a portion of the downstream fan. The upstream motor support is located upstream of the upstream fan and the downstream motor support is located downstream of the downstream fan.

In some embodiments of the fan assembly, the upstream and downstream motor supports include vanes. The vanes have cross sections that have a chord line, a chord length and a maximum thickness. The chord length is greater than the maximum thickness, and the chord line is oriented substantially in the direction of the rotation axis.

in some embodiments of the fan assembly, the chord length is between 4 and 15 times the maximum thickness.

In some embodiments of the fan assembly, the vanes have a leading edge, and the leading edge is rounded.

In some embodiments of the fan assembly, the vanes have a trailing edge, and the thickness at the trailing edge is less than the maximum thickness.

In some embodiments of the fan assembly, the counter-rotating fan assembly further includes an air guide configured to guide air between a heat exchanger and the fan assembly.

In some embodiments of the fan assembly, the counter-rotating fan assembly includes a provision whereby it can be attached to a separate air guide configured to guide air between a heat exchanger and the fan assembly.

In some embodiments of the fan assembly, the barrel and the upstream and downstream motor supports are injection molded of one or more plastic materials.

In some embodiments of the fan assembly, the air guide, the barrel, and the upstream and downstream motor supports are injection molded of one or more plastic materials.

In some embodiments of the fan assembly, the downstream motor support is integrally formed with a portion of the barrel, and the portion of the barrel surrounds at least a portion of the downstream fan and at least a portion of the upstream fan.

In some embodiments of the fan assembly, the radial dimension of the inner surface of the upstream end of the barrel portion is greater than the radial dimension of the inner surface of the downstream end of the barrel portion.

In some embodiments of the fan assembly, the upstream motor support is molded integrally with a ring structure that connects the outer extremities of the vanes.

In some embodiments of the fan assembly, the upstream motor support is integrally formed with the air guide.

In some embodiments of the fan assembly, the barrel is integrally formed with the air guide.

In some embodiments of the fan assembly, the upstream and downstream fans are free-tipped.

In some embodiments of the fan assembly, at least one of the upstream and downstream fans includes a band that connects the tips of the blades.

A method is described for assembling a counter-rotating fan assembly. The counter-rotating fan assembly includes an upstream fan and a downstream fan, rotating in opposite directions around a substantially common axis. The fan assembly includes an upstream motor driving the upstream fan, and an upstream motor support which supports the upstream motor, a downstream motor driving the downstream fan, and a downstream motor support which supports the downstream motor. In addition, the fan assembly includes a barrel surrounding at least a portion of the upstream fan and a portion of the downstream fan. The upstream motor support is located upstream of the upstream fan and the downstream motor support is located downstream of the downstream fan. The method includes assembling a first subassembly that includes the upstream fan, the upstream motor, and the upstream motor support, assembling a second subassembly that includes the downstream fan, the downstream motor, and the downstream motor support, and assembling the first subassembly with the second subassembly to provide a third subassembly.

DETAILED DESCRIPTION

Figure 1A:
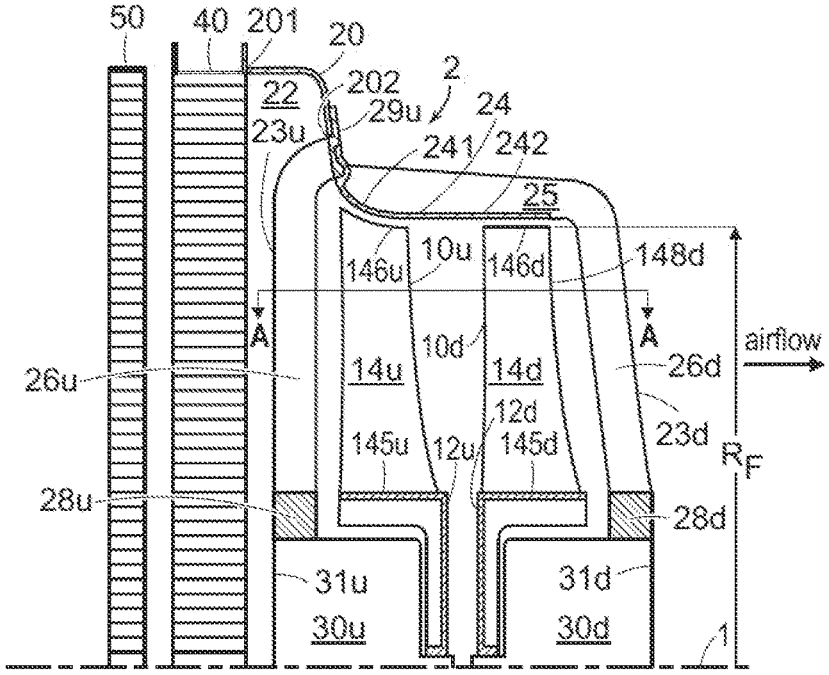
FIG. 1*a* is a meridional view of a counter-rotating fan assembly.

FIG. 1*a* shows a meridional section through an automotive radiator 50, a condenser 40. and a counter-rotating fan assembly 2. The condenser 50 is mounted in front of the radiator 40, to which an air guide 20 is attached. The fan assembly 2 is attached to the air guide 20. The fan assembly 2 pulls air through the condenser 50 and the radiator 40, and discharges the air in the direction indicated. The fan assembly 2 includes an upstream fan 10*u* and a downstream fan 10*d*. The upstream and downstream fans 10*u*, 10*d* are configured to rotate about a substantially common rotation axis 1, and turn in opposite directions, as discussed in detail below.

It is understood that, in use, the rotation axes of the upstream and downstream fans 10*u*, 10*d* may not be precisely common (e.g., co-linear). In some embodiments the axes are described as "substantially common" when they are parallel, but with a small distance between them. In other embodiments the axes are described as "substantially common" when there is a small angle formed between the axes, and the distance between the intersections of the two axes with a plane perpendicular to the rotation axis of the downstream fan that passes through the upstream-most portion of the hub of the downstream fan is sufficiently small. The small angle between the fan rotation axes may be less than twelve degrees, or less than six degrees, or less than three degrees. The small distance between the fan rotation axes may be less than twelve percent of the downstream fan diameter, or less than six, percent of the downstream fan diameter, or less than three percent of the downstream fan diameter. The downstream fan diameter is defined to be twice the radial distance $R_F$ from the downstream fan rotation axis to the downstream blade tip 146*d* at the trailing edge 148*d*.

The air guide 20 is a structure having an open upstream end that is attached to, or fixed adjacent to, the downstream-most heat exchanger, and an open downstream end that is attached to the fan assembly 2. In most embodiments, the upstream end 201 of the air guide 20 has a shape and dimensions that correspond to the shape and dimensions of the downstream-most heat exchanger, which is often rectangular. The downstream end 202 of the air guide 20 generally has a smaller area than the upstream end, whereby the air guide 20 serves to accelerate air into the fan assembly 2. In most embodiments, the downstream end 202 of the air guide 20 has a circular shape. The air guide 20 both guides the air and contains a volume of air which is at a lower pressure than the air surrounding the air guide 20.

The fan assembly 2 includes a barrel 24, which is a tubular structure that includes a flared inlet portion 241 and a cylindrical portion 242 that is disposed downstream of the inlet portion 241. The radial dimension of the inner surface of the upstream end of the inlet portion 241 is larger than the radial dimension of the inner surface of the cylindrical portion 242. The inlet portion 241 facilitates the smooth entrance of air into the barrel 24. In other embodiments, the inlet portion 241 may extend over a smaller or larger portion of the barrel 24, or even the entire barrel 24. The cylindrical portion 242 may be only approximately cylindrical. When molded as a plastic part, a required draft angle may dictate that the radial dimension varies slightly along the axial extent. In the illustrated embodiment, a dimension of the barrel in a direction parallel to the fan rotation axis 1 is less than the radial distance $R_F$. In other embodiments, the dimension of the barrel in a direction parallel to the fan rotation axis 1 is less than twice the radial distance $R_F$.

The upstream fan 10*u* is driven to rotate about the rotation axis 1 by an upstream electric motor 30*u*, which is mounted on an upstream motor mount 28*u*. The upstream motor mount 28*u* is supported by multiple vanes 26*u* which extend radially outward from the upstream motor mount 28*u* and are joined to the inner surface of a ring structure 29*u*. This ring structure 29*u* is attached to the air guide 20 in such a way that the inner wall of the ring structure 29*u* and the inner wall of the air guide 20 form a smooth surface. The upstream motor mount 28*u* and vanes 26*u* together provide an upstream motor support 23*u* that is positioned upstream of the upstream fan 10*u*.

The upstream fan 10*u* is a free-tipped fan, and includes a hub 12*u*, and multiple blades 14*u*. The tips 146*u* of the fan blades 14*u* are shaped to maintain an approximately constant clearance with respect to the barrel inlet portion 241. The barrel inlet portion 241 is configured to be attached to the ring structure 29*u* in such a way that the inner surface of the barrel inlet portion 241 and the inner surface of the ring structure 29*u* form a smooth surface.

The downstream fan 10*d* is driven to rotate about the rotation axis 1 in a direction opposite to that of the upstream fan 10*u*. The downstream fan 10*d* is driven by an electric motor 30*d*, which is mounted on a downstream motor mount 28*d*. The downstream motor mount 28*d* is supported by multiple vanes 26*d* which extend radially outward from the downstream motor mount 28*d*. The outer end of each vane 26*d* is joined to one of a plurality of axially-extending ribs 25 that protrude outward from an outer surface of the barrel 24. The downstream motor mount 28*d* and vanes 26*d* together provide a downstream motor support 23*d* that is positioned downstream of the downstream fan 10*d*.

The downstream fan 10*d* is a free-tipped fan, and includes a hub 12*d*, and multiple blades 14*d*. The tips 146 of the fan blades 14*d* maintain an approximately constant clearance with respect to the cylindrical portion of the barrel 242. The cylindrical portion 242 terminates at an axial position approximately adjacent to a trailing edge 148*d* of the blade 14*d*.

FIG. 1*a* shows an embodiment where the upstream fan blade tips 146*u* are located adjacent to the barrel inlet portion 241, and the downstream blade tips 146*d* are located adjacent to the cylindrical portion 242 of the barrel 24. In other embodiments, a portion of the upstream blade tips 146*u* may extend into the cylindrical portion 242 of the barrel 24. In still other embodiments, a portion of the downstream blade tips 146*d* may extend into the barrel inlet portion 241.

Because the motors 30*u* and 30*d* are facing in opposite directions, they can be identical, and still rotate the fans 10*u* and 10*d* in opposite directions. This can be advantageous when manufacturing the assembly.

The fan assembly 2 as shown in FIG. 1*a* features an arrangement of motor supports which is advantageous in that it can provide adequate cooling to the motors. Electric motors are less than 100 percent efficient, and the heat generated by the motors must be removed to avoid an overheated condition. The back side 31*u* of the upstream motor 30*u* is exposed to the air leaving the radiator 40. Although heated by the. radiator 40, this air is cooler than the upstream motor 30*u*, and can provide cooling. Similarly, the back side 31*d* of the downstream motor 30*d* is exposed to the air leaving the downstream fan 14*d*, and the ambient air downstream of the fan assembly. This air is cooler than the downstream motor 30*d*, and can provide cooling. The illustrated arrangement can be compared to some alternative arrangements of motor supports in counter-rotating fan assemblies in which one or more motors are positioned between the upstream fan and the downstream fan. In some cases, this alternative arrangement may be problematic in that there may be very little air moving over the motors to remove the generated heat.

Various additional embodiments of the fan assembly are described below. These embodiments feature fan assemblies which include features in common with the fan assembly 2 illustrated in FIG. 1*a*. These common elements are referred to with common reference numbers.

Figure 1B:
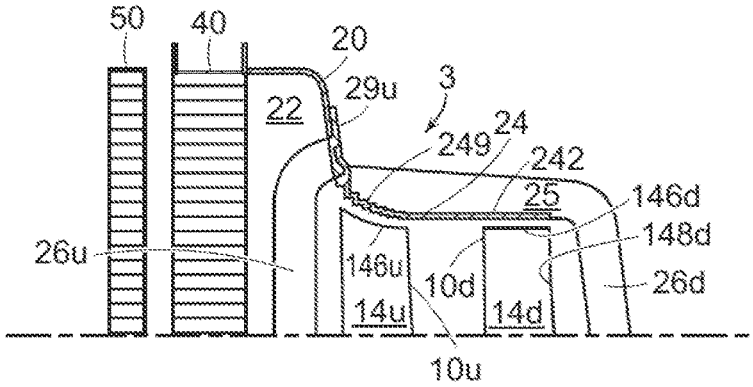
FIG. 1*b* is a meridional view of a portion of a counter-rotating fan assembly according to an embodiment in which the barrel inlet is stepped.

FIG. 1*b* shows another embodiment of the fan assembly. In the fan assembly 3 illustrated in FIG. 1*b* the inlet portion 249 of the barrel 24 is stepped, as described in U.S. patent application Ser. No. 15/563,842. The contents of U.S. patent application Ser. No. 15/563,842 are incorporated by reference herein. The stepped barrel geometry has been shown to reduce the noise of a free-tipped fan.

Figure 1C:
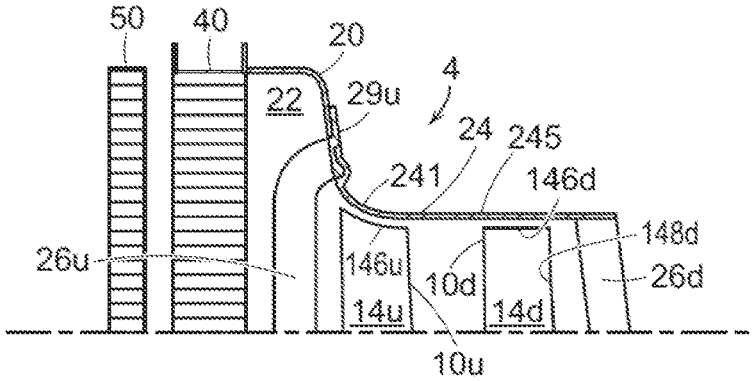
FIG. 1*c* is a meridional view of a portion of a counter-rotating fan assembly according to an embodiment in which the barrel extends downstream to support the vanes of the downstream motor support.

FIG. 1*c* shows another embodiment of the fan assembly. In the fan assembly 4 illustrated in FIG. 1*c*, portions of the cylindrical barrel portion 245 extend downstream beyond the trailing edge 148*d* of the downstream blade 14*d*, and are connected to the vanes 26*d*. The section shown in FIG. 1*c* is in a meridional plane at the azimuthal location of a vane. In other meridional planes at azimuthal locations between the vanes, the barrel 24 may be terminated near the trailing edge 148*d* of the downstream blade 14*d*. In other, similar, embodiments, the barrel 24 is stiffened with external ribs located at the azimuthal locations of the vanes.

The fan assemblies 2, 3, 4 shown in FIGS. 1*a*, 1*b*, and 1*c* are space-efficient. Because fans are typically somewhat smaller than the heat exchangers through which they draw air, the efficiency of the fan module is increased by increasing the axial distance between the heat exchanger and the inlet portion 241, 249 of the barrel 24. The space 22 enclosed by the air guide 20 allows the air which passes through the heat exchanger radially outward of the barrel inlet portion 241, 249 to enter the barrel inlet portion 241, 249 with a minimum of restriction. By placing the upstream motor support 23*u* upstream of the upstream fan 10*u*, the space between the barrel inlet portion 241, 249 and the heat exchanger serves both an aerodynamic and a structural function.

Figure 2A:
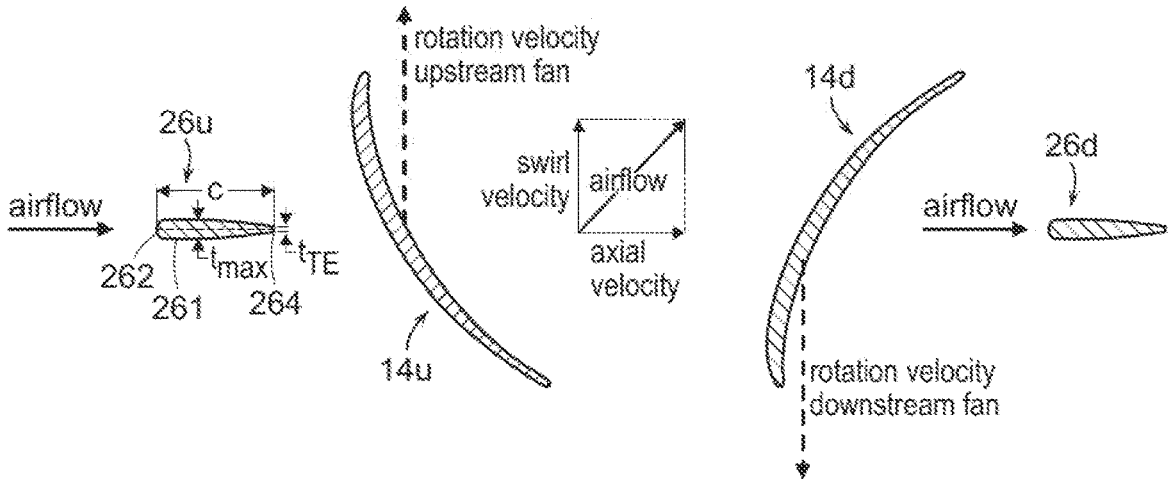
FIG. 2*a* is the cylindrical section A-A, as indicated in FIG. 1*a*, showing the fan blades and support vanes.

FIG. 2*a* is the cylindrical section A-A indicated in FIG. 1*a*. The cylindrical section represents the intersection of the vanes 26*u*, the fan blades 14*u* and 14*d*, and the vanes 26*d* with a cylinder the axis of which is the fan rotation axis 1. The cross section of each upstream vane 26*u* has a chord line 261 corresponding to a straight line that extends between the vane leading edge 262 and the vane trailing edge 264. The chord line. 261 has a chord length c which is the length of the chord line. In the illustrated embodiment, the chord length is approximately 6 times larger than the maximum thickness $t_{max}$. The vane leading edge 262 is rounded, and the thickness $t_{TE}$ at the vane trailing edge 264 is less than the maximum thickness $t_{max}$. The size and shape of a given vane 26*u* may reduce the severity of the viscous wake downstream of the vane, and thereby decrease the drag of the vane and reduce the noise generated when a fan blade moves through the wake. The chord line 261 is generally aligned with the local airflow, and, as shown, is approximately parallel to the rotation axis 1. As used herein, the term "approximately parallel" is used to indicate that the angle between the chord line 261 and the rotation axis 1 is less than twelve degrees. In other embodiments, the term "approximately parallel" is used to indicate that the angle between the chord line 261 and the rotation axis 1 is less than six degrees. In still other embodiments, the term "approximately parallel" is used to indicate that the angle between the chord line 261 and the rotation axis 1 is less than three degrees. The cross section of the downstream vane 26*d* is similar in size, shape, and orientation. The downstream vane 26*d* is also generally aligned with the local airflow, and, as shown, is approximately parallel to the rotation axis 1. This relationship between the vane orientation and the air flow direction is maintained at all operating points.

FIG. 2*a* also shows schematically the rotation directions of an upstream blade 14*u* and a downstream blade 14*d*, as well as the direction of the airflow between the upstream blades 14*u* and the downstream blades 14*d*. At that location, the air has an axial velocity approximately equal to the axial velocity upstream, of the upstream blades 14*u* and downstream of the downstream blades 14*d*, but in addition has a swirl component of velocity. The total speed of the air is thereby increased.

Figure 2B:
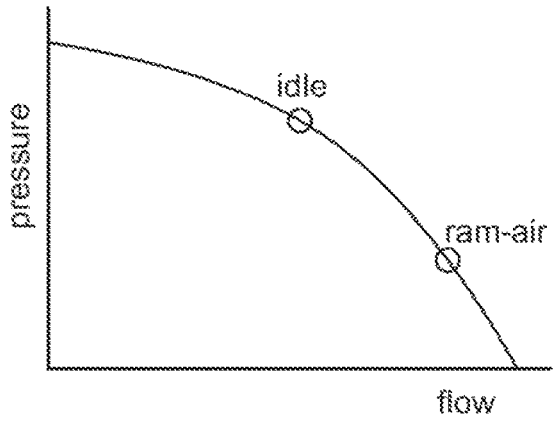
FIG. 2*b* is a head-capacity curve of an automotive cooling fan, identifying an idle operating point and a ram-air operating point.
Figure 2C:
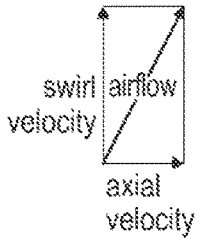
FIG. 2*c* is a vector diagram of the air velocity between the fans at the idle operating point identified on the head-capacity curve of FIG. 2*b*.
Figure 2D:
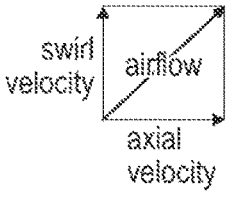
FIG. 2*d* is a vector diagram of the air velocity between the fans at the ram-air operating point identified on the head-capacity curve of FIG. 2*b*.

FIG. 2*b* shows the head-capacity curve of a counter-rotating fan assembly such as the fan assembly 2 illustrated in FIG. 1*a*. In FIG. 2*b*, the vertical axis represents the pressure developed, and the horizontal axis represents the flow delivered. The operating point of the fan assembly 2 when the vehicle is stationary is shown as the "idle" point. The operating point when the vehicle is moving is shown as the "ram-air" point. At the ram-air point, the fan assembly 2 is generating less pressure, and is moving more air than at the idle point. FIGS. 2*c* and 2*d* are velocity, diagrams of the flow at a particular radius between the upstream and downstream blades 14*u*, 14*d* at the respective operating points. At the idle point (FIG. 2*c*), the swirl velocity is high, and the axial velocity is low, so the flow angle relative to the rotation axis 1 is quite large. At the ram-air point (FIG. 2*d*), the swirl velocity is low, the axial velocity is large, and the angle is smaller.

The designer of a fan assembly which places a support vane between the upstream and downstream fans must choose one operating point where the vane will be aligned with the local airflow. At other operating points the vane may be misaligned. When the vane is misaligned, the wake behind the vane may be more severe than in the case of an aligned vane, and the downstream fan may see a greater non-uniformity in velocity, and higher turbulence levels. The fan assembly may experience a loss of efficiency and increased noise.

Figure 2E:
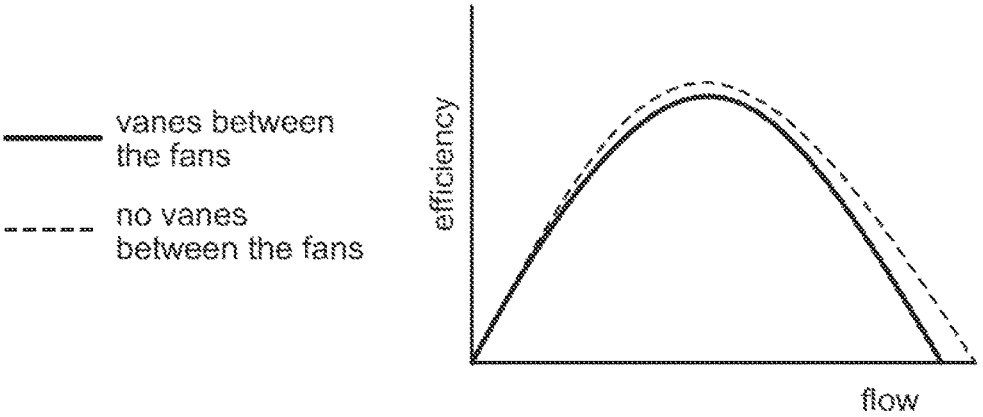
FIG. 2*e* is a plot of efficiency versus flow, in which the solid line represents the efficiency curve for a fan assembly having vanes disposed between the fans and the broken line represents the efficiency curve for a fan assembly having no vanes disposed between the fans, showing the benefit of a design without vanes between the upstream and downstream fans.

The counter-rotating fan assembly 2 shown in FIGS. 1*a* and 2*a* benefits from the placement of the support vanes 26*u*, 26*d* in regions where the airflow direction is approximately axial at all operating points. One benefit is that the air velocity is relatively low in these regions, and the drag of a vane, which varies roughly as the square of the air velocity, will also be low. This can result in an increased efficiency. The other benefit is that no vane misalignment occurs when the operating point differs from the design point. This can result in higher efficiency and lower noise at off-design conditions. FIG. 2*e* depicts the change in the curve of efficiency that one might expect by moving vanes from a location between the fans to locations where the flow is axial at all operating conditions—both the height and the breadth of the curve may be increased.

In some embodiments, the air guide 20, the barrel 24, and the upstream and downstream motor supports 23*u*, 23*d* are injection molded of a plastic material. For example, the air guide 20, the barrel 24, and the upstream and downstream motor supports 23*u*, 23*d* may be injection molded as three separate parts (FIG. 3*a*), which can be assembled with fasteners (FIG. 4*a*). An advantage of molding the air guide 20 as a separate part is that in some cases the air guide 20 can be made of a different material and to looser tolerances than the barrel 24 and the upstream and downstream motor supports 23*u*, 23*d*.

Figure 4A:
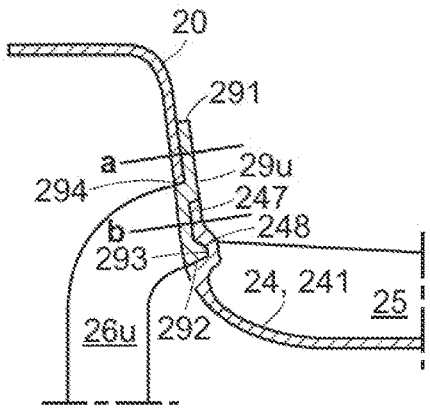
FIG. 4*a* is an enlarged view of the resulting structure when the three molded parts shown in FIG. 3*a* are fastened together.

In other examples, the air guide 20, the barrel 24, and the upstream and downstream motor supports 23*u*, 23*d* are injection molded as two separate parts. In some embodiments, the air guide 20 is molded integrally with the upstream motor support 23*u* (FIGS. 3*b* and 4*b*). In other embodiments, the air guide 20 is molded integrally with the barrel 24 (FIGS. 3*c* and 4*c*). An advantage of a two-piece design is that it may reduce the cost of manufacturing the fan assembly.

Figure 3A:
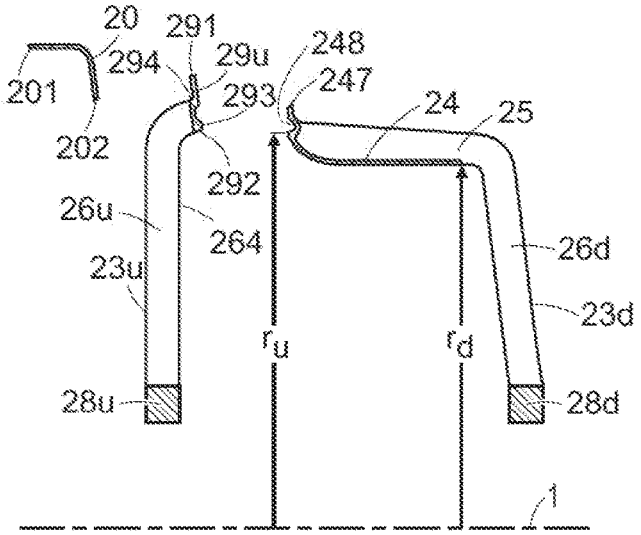
FIG. 3*a* is an exploded meridional view of the air guide, the barrel, and the upstream and downstream motor supports as molded in three separate, injection-molded parts.
Figure 3B:
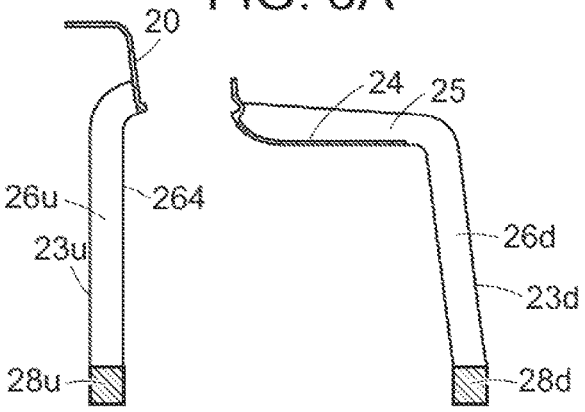
FIG. 3*b* is an exploded meridional view of the air guide, the barrel, and the upstream and downstream motor supports as molded in two separate, injection-molded parts, with the upstream motor support integrally molded with the air guide.
Figure 4B:
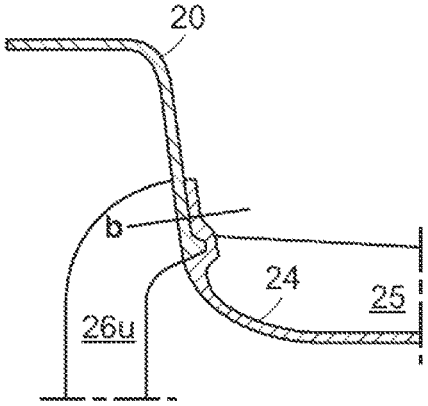
FIG. 4*b* is an enlarged view of the resulting structure when the two molded parts shown in FIG. 3*b* are fastened together.
Figure 3C:
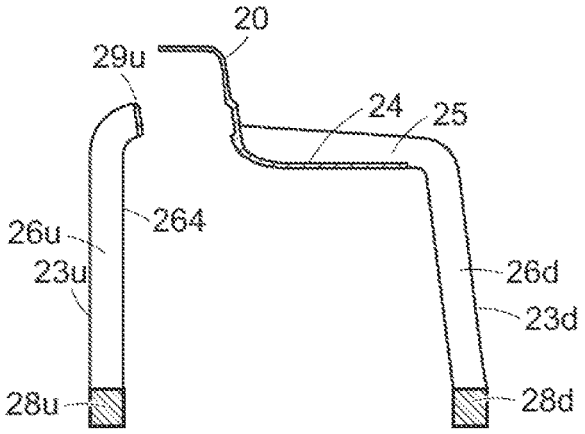
FIG. 3*c* is an exploded meridional view of the air guide, the barrel, and the upstream and downstream motor supports as molded in two separate, injection-molded parts, with the barrel integrally molded with the air guide.
Figure 4C:
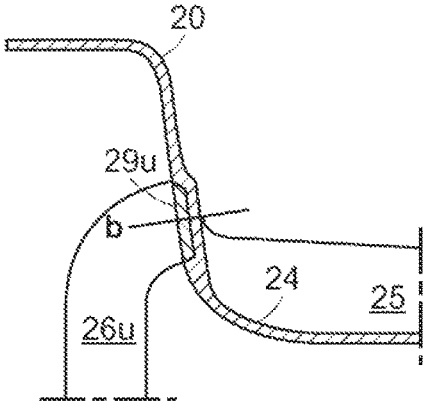
FIG. 4*c* is an enlarged view of the resulting structure when the two molded parts shown in FIG. 3*c* are fastened together.

In FIGS. 3*a*, 3*b*, and 3*c*, the entire barrel 24 is molded integrally with the downstream motor support 23*d*. This molding strategy is desirable when, as shown in FIG. 3*a*, the radial dimension $r_u$ of the inner surface of the barrel 24 at the upstream end of the barrel 24 is larger than the radial dimension $r_d$ of the inner surface of the barrel 24 at the downstream end. It allows the upstream fan blade tips 146*u* to conform to the barrel inlet portion 241, since the barrel 24 is fastened to the ring structure 29*u* after the upstream fan 10*u* is installed. This would not be possible if a significant portion of the barrel inlet portion 241 were molded integrally with the ring structure 29*u*.

In order to mold the upstream motor support 23*u* without complex tooling, the trailing edge 264 of the upstream vanes 26*u* can be formed only at radii smaller than the minimum radial dimension of the inner surface of any barrel portion molded with the ring structure 29*u*. Molding the entire barrel 24 integrally with the downstream motor support 23*d* allows the upstream vane trailing edges 264 to be formed along the entire length of the vanes 26*u*. This allows the vanes 26*u* to be terminated at a distance from the upstream fan blade tips 146*u* and reduces the noise generated as the upstream fan blades 14*u* move through the wakes of the upstream vanes 26*u*.

The assembly process is as follows. The upstream motor 30*u* is fastened to the upstream motor mount 28*u*, and the upstream fan 10*u* is mounted on the upstream motor 30*u*. Similarly, the downstream motor 30*d* is fastened to the downstream motor mount 28*d*, and the downstream fan 10*d* is mounted on the downstream motor 30*d*. The dynamic balance of these fan subassemblies can be checked and corrected. When both fans 10*u*, 10*d* are mounted, and any balancing operations completed, the plastic piece comprising the upstream motor support 23*u* is fastened to the plastic piece comprising the downstream motor support 23*d* to form the complete fan assembly 2.

The efficient and quiet performance of the free-tipped upstream fan 10*u* depends on maintaining a small tip gap between the blade tip 146*u* and the barrel 24. Maintaining the tip gap uniformly around the circumference requires the correct relative positioning of the plastic parts. FIG. 4*a* is a detailed view of the resulting structure when the three separately molded parts shown in FIG. 3*a* are joined, showing features that accurately locate the barrel 24 with respect to the ring structure 29*u*. The upstream end 247 of the barrel inlet portion 241 overlies a portion of the outer surface of the ring structure 29*u*. A circumferentially-extending ridge 293 protrudes outward from the ring structure outer surface. The ridge 293 is received by a circumferentially-extending groove 248 provided in the inner surface of the barrel inlet portion 241. The cooperative engagement between the ridge 293 and the groove 248 guarantees an accurate mating of the barrel 24 with the ring structure 29*u*. The barrel 24 and the ring structure 29*u* can he attached by a circumferential array of fasteners (not shown) at meridional location "b".

Because the weight of the fan assembly 2 may be supported by the air guide 20, features are provided to assure the robust attachment of the ring structure 29*u* to the air guide. An upstream end 291 of the ring structure 29*u* overlies an outer surface of the air guide 20. The upstream end 291 is outwardly offset relative to the downstream end 292, whereby the mid portion of the ring structure 29*u* is provided with an inner shoulder 294 that abuts the end face of the downstream end 202 of the air guide 20. This serves to locate the fan assembly, and allows the air guide to hear the weight of the fan assembly. The fan assembly 2 can be fastened to the air guide 20 by an array of fasteners (not shown) at meridional location "a".

FIGS. 4*b* and 4*c* are detailed views of the joining of two separately molded parts, as shown in FIGS. 3*b* and 3*c*, respectively. Once again, features are provided which guarantee the correct alignment of the barrel 24 and the upstream motor support 23*u*. The two parts can he attached by a circumferential array of fasteners (not shown) at the meridional location "b".

Figure 5:
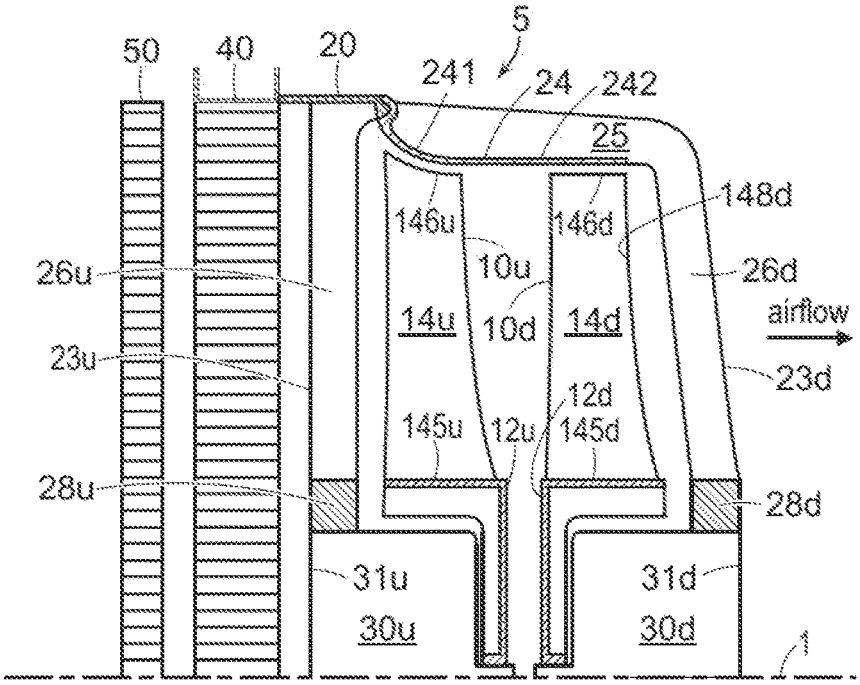
FIG. 5 is a meridional view of a counter-rotating fan assembly according to an embodiment where the barrel inlet has almost the same transverse dimension as the heat exchanger, and the upstream motor support is connected to the side wall of the air guide.

In order to minimize air flow non-uniformity through the heat exchanger, it is desirable for the barrel inlet portion to have almost the same transverse dimension as the smallest dimension of the heat exchanger, which in modern automotive vehicles is often the vertical dimension. FIG. 5 shows an embodiment where the fan assembly 5 is sized in this way. In this embodiment, the air guide 20 and the upstream motor support 23*u* are molded as a single piece, and in the regions where the barrel inlet portion 241 approaches the axially-extending side wall of the air guide 20, the upstream motor support 23*u* is connected directly to the side wall.

Figure 6:
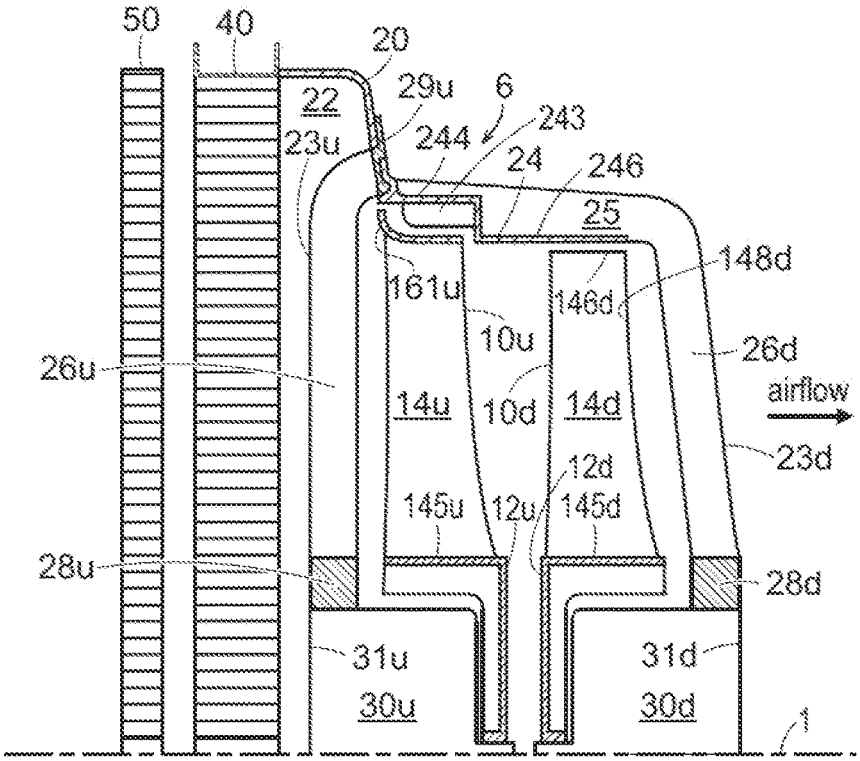
FIG. 6 is a meridional view of a counter-rotating fan assembly according to an embodiment in which the upstream fan is banded.

FIG. 6 shows another embodiment of the fan assembly. In the fan assembly 6 illustrated in FIG. 6, the upstream fan 10*u* is a banded fan, where the blade tips 146*u* are connected by a rotating band 16*u*. The band features a. lip 161*u* at the leading edge. In addition, the barrel 24 includes a barrel upstream portion 244 and a barrel downstream portion 246, and the inner surface of barrel upstream portion 244 has a larger radial dimension than does the inner surface of barrel downstream portion 246. The barrel upstream portion 244 includes recirculation-control vanes 243, which are described in U.S. Pat. No. 5,489,186. The contents of U.S. Pat. No. 5,489,186 are incorporated by reference herein. The recirculation-control vanes 243 protrude radially inward from the inner surface of the barrel upstream portion 244, and condition the flow that recirculates between the band 16*u* and the barrel upstream portion 244. The recirculation-control vanes 243 have been shown to increase fan efficiency and reduce fan nurse As in embodiments which include a free-tipped upstream fan, the entire barrel 24 is molded integrally with the downstream motor support 23*d*. This allows the band 16*u* and the barrel 24 to feature the recirculation-control features shown without molding and assembling an additional part. As in embodiments which include a free-tipped upstream fan, the barrel 24 is fastened to the ring structure 29*u* after the upstream fan 10*u* is installed.

Figure 7:
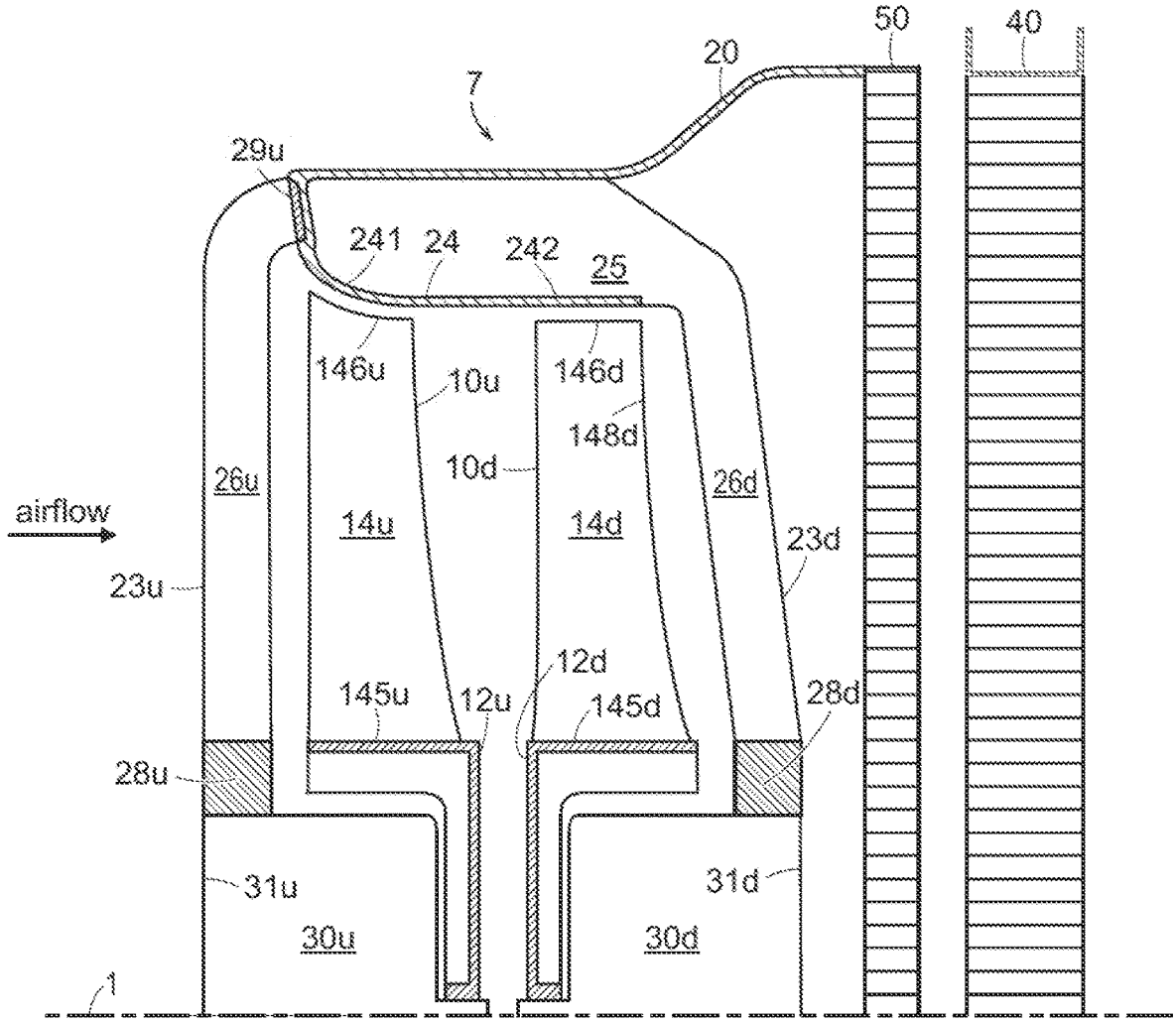
FIG. 7 is a meridional view of a counter-rotating fan assembly according to an embodiment in which the fan assembly is located upstream of a set of heat exchangers.

FIG. 7 shows another embodiment of the fan assembly. In the fan assembly 7 illustrated in FIG. 7, the counter-rotating fan assembly 7 is positioned upstream of the radiator 40 and the condenser 50, and pushes air through those heat exchangers. In this embodiment, the air guide 20 is molded integrally with the barrel 24. In other embodiments featuring such a pusher arrangement, the air guide 20 may be molded integrally with the upstream motor support 23*u*, or may be molded as a separate part.

The placement of motor supports 23*u*, 23*d* as described here lends itself to the provision of a finger guard without increasing the number of molded parts. In the case of a puller arrangement, as shown in FIGS. 1*a-c*, 5, and 6, this finger guard can be molded integrally with the downstream motor support 23*d*. In the pusher arrangement shown in FIG. 7, it can be molded integrally with the upstream motor support 23*u*.

Although the heat exchangers shown in the figures are identified as a radiator 40 and a condenser 50, in other embodiments the counter-rotating fan assembly may move air through. various other heat exchangers. In a vehicle powered by an internal combustion engine, these heat exchangers may include charge-air coolers and oil coolers. In an electric vehicle, they may include evaporators and additional radiators.

Although the sectional views shown in the figures show both upstream motor support vanes 26*u* and downstream motor support vanes 26*d*, in some embodiments these may be located at different azimuthal positions. In some embodiments there may be a different number of upstream vanes 26*u* and downstream vanes 26*d*. However, in embodiments featuring external ribs at the location of the downstream vanes 26*d*, maximum stiffness is provided when the number and azimuthal locations of upstream and downstream vanes is identical.

Fan assemblies having properties according to one or more aspects of the present application can feature forward-skewed, back-skewed, radial, or mixed-skew fans. Similarly, fan assemblies according to one or more aspects of the present application can feature fans having any number of blades and any distribution of blade angle, camber, chord, or rake.

Selective illustrative embodiments of the fan assembly are described above in some detail. It should be understood that only structures considered necessary for clarifying the fan assembly have been described herein. Other conventional structures, and those of ancillary and auxiliary components of the fan assembly, are assumed to be known and understood by those skilled in the art. Moreover, while a working example of the fan assembly has been described above, the fan assembly is not limited to the working example described above, but various design alterations may be carried out without departing from the fan assembly as set forth in the claims.

I claim:

1. A counter-rotating fan assembly, comprising:

an upstream fan;

a downstream fan that rotates in a direction opposite to a rotational direction of the upstream fan, the upstream fan and the downstream fan rotating about a substantially common rotation axis;

an upstream motor that drives the upstream fan;

an upstream motor support that supports the upstream motor;

a downstream motor that drives the downstream fan;

a downstream motor support that supports the downstream motor; and a barrel that surrounds at least a portion of the upstream fan and a portion of the downstream fan, characterized in that, the upstream motor support is located upstream of the upstream fan, the downstream motor support is located downstream of the downstream fan, the upstream motor support and the downstream motor support comprise a plurality of vanes, each vane has a cross section that includes a chord line that extends between a leading edge of the vane and a trailing edge of the vane, a chord length that corresponds to the length of the chord line, and a maximum thickness, the chord length is greater than the maximum thickness, and the chord line is oriented parallel to the rotation axis.

2. The fan assembly of claim 1, where the chord length is between 4 and 15 times the maximum thickness.

3. The fan assembly of claim 1, where the leading edge is rounded.

4. The fan assembly of claim 1, where the thickness at the trailing edge is less than the maximum thickness.

5. The fan assembly of claim 1, where the upstream motor support comprises a plurality of vanes, and the upstream motor support is plastic, and is molded integrally with a ring structure that connects the outer extremities of the vanes.

6. The fan assembly of claim 1, comprising an air guide configured to guide air between a heat exchanger and the fan assembly.

7. The fan assembly of claim 6, wherein the air guide, the barrel, the upstream motor support and the downstream motor support are injection molded of one or more plastic materials.

8. The fan assembly of claim 7, where the upstream motor support is integrally formed with the air guide.

9. The fan assembly of claim 7, where the barrel is integrally formed with the air guide.

10. The fan assembly of claim 7, where the downstream motor support is integrally formed with a portion of the barrel which surrounds at least a portion of the downstream fan and at least a portion of the upstream fan.

11. The fan assembly of claim 10, where a radial dimension of an inner surface of an upstream end of the barrel portion is greater than a radial dimension of an inner surface of a downstream end of the barrel portion.

12. The fan assembly of claim 1, where the fan assembly is configured to be attached to a separate air guide, and the separate air guide is configured to guide air between a heat exchanger and the fan assembly.

13. The fan assembly of claim 1, where the barrel, the upstream motor support and the downstream motor support are injection molded of one or more plastic materials.

14. The fan assembly of claim 13, where the downstream motor support is integrally formed with a portion of the barrel which surrounds at least a portion of the downstream fan and at least a portion of the upstream fan.

15. The fan assembly of claim 14, where a radial dimension of an inner surface of an upstream end of the barrel portion is greater than a radial dimension of an inner surface of a downstream end of the barrel portion.

16. The fan assembly of claim 1, where the upstream fan and the downstream fan are each a free-tipped fan.

17. The fan assembly of claim 1, where at least one of the upstream fan and the downstream fan is a banded fan.

18. The fan assembly of claim 1, wherein each vane is free of camber.

* * * * *